United States Patent [19]

Palazzo

[11] Patent Number: 4,640,439

[45] Date of Patent: Feb. 3, 1987

[54] DOUBLE WALL STORAGE TANK FOR LIQUIDS AND METHOD OF MAKING SAME

[76] Inventor: David T. Palazzo, P.O. Box 290676, Tampa, Fla. 33687

[21] Appl. No.: 775,140

[22] Filed: Sep. 12, 1985

[51] Int. Cl.[4] ..... B65D 87/24

[52] U.S. Cl. ..... 220/445; 220/420

[58] Field of Search ..... 220/445, 420, 446, 448, 220/469, 1 B, 465; 73/855, 49.2

[56] References Cited

U.S. PATENT DOCUMENTS

| | | | |
|---|---|---|---|
| 761,548 | 5/1904 | Sheaff | 220/445 |
| 3,848,765 | 11/1974 | Durkop | 220/445 |
| 4,523,454 | 6/1985 | Sharp | 220/449 |
| 4,524,609 | 6/1985 | Sharp | 73/49.2 |
| 4,537,328 | 8/1985 | Keesee et al. | 220/445 |

*Primary Examiner*—George T. Hall

*Attorney, Agent, or Firm*—Pettis & McDonald

[57] ABSTRACT

A double wall tank for the storage of liquids is manufactured from a rigid single wall inner tank by applying a spacing material to at least a portion of the exterior surface of the inner tank and applying over that inner tank exterior surface and the spacing material a substantially rigid outer sheath of a material that is substantially liquid-tight.

19 Claims, 6 Drawing Figures

DOUBLE WALL STORAGE TANK FOR LIQUIDS AND METHOD OF MAKING SAME

FIELD OF THE INVENTION

This invention relates to tanks for the storage of liquids, and more particularly to double wall tanks for underground storage of liquids.

BACKGROUND OF THE INVENTION

Tanks for the storage of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tanks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has prompted the search for methods of fabricating relatively inexpensive double wall tanks. This burden has also given impetus to the search for a method of remanufacturing existing single wall tanks into a double wall assembly with means for detecting the presence of any leaks into the space between the two walls.

SUMMARY OF THE INVENTION

In view of the foregoing, it is the object of the present invention to provide an economical method of manufacturing a double wall storage tank from rigid single wall tank. It is a further object of the invention to provide such a method in which at least a portion of the outer wall or sheath of the tank is spaced from the inner tank.

To achieve these and other objects that will become readily apparent to those skilled in the art, this invention provides a method of manufacturing from a rigid single wall inner tank a rigid double wall tank for the storage of liquids. This method includes the steps of applying to at least a portion of the exterior surface of the rigid inner tank a spacing material providing for substantially free passage of liquids along a substantial portion of the internal tank surface, applying over the inner tank exterior surface and the spacing material a substantially rigid outer sheath of a material that is substantially liquid tight, such sheath being spaced from at least a portion of the inner tank exterior surface by the spacing material.

In a preferred embodiment of the invention the spacing material may comprise a mesh material, with the outer sheath being formed of a resin impregnated glass fiber material supported by the mesh material away from the inner tank.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENTS

Figure 1:
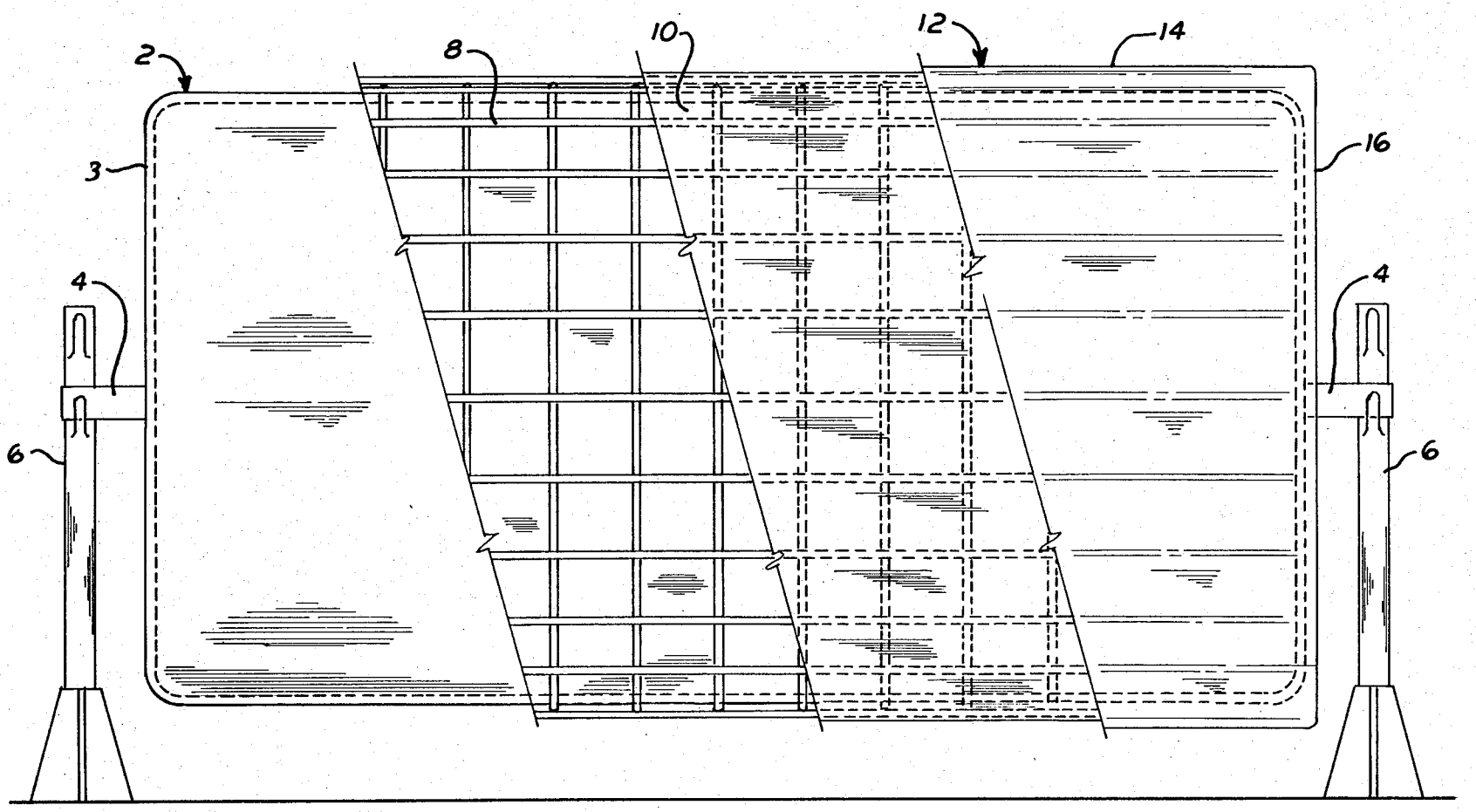
FIG. 1 is a side elevation, partially in section, of a tank according to the present invention, illustrating various steps in the fabrication process.
Figure 6:
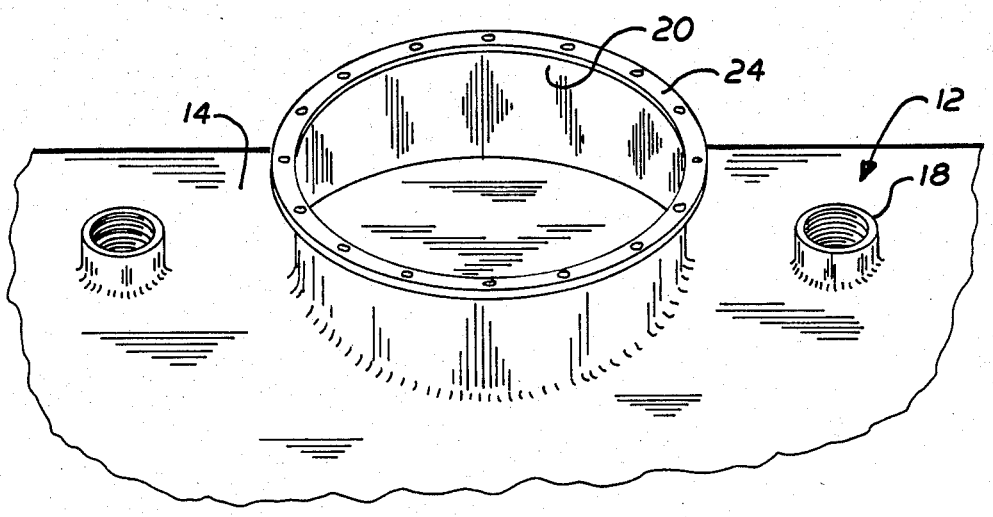
FIG. 6 is a perspective view of the apparatus of FIG. 5 illustrating the completed installation of a port and of plumbing connections.

A preferred embodiment of the apparatus of this invention is illustrated in FIGS. 1, 2, 3 and 6. FIG. 1 is a side elevational view illustrating the manner of making the completed tank assembly by the application of the various materials to the inner storage tank.

While various forms and shapes of tanks may be utilized in practicing this invention, the most common shape utilized for underground storage is that of a cylinder, generally a right circular cylinder, having closed end portions. For simplicity of illustration this configuration of tank is utilized for illustrating the preferred embodiment of the invention. Also, while virtually any construction of a rigid inner tank, whether of metal or fiberglass or of other materials, may be utilized in practicing this invention, one preferred and readily available type of structure is a tank formed of welded steel, having an appropriate corrosion resisting coating on the liquid contacting surfaces. For purposes of illustration such a steel tank will be described. It also is to be understood that the tank to be used could be a newly fabricated tank, which may or may not have any manhole opening cut in it, or it may be a previously used tank removed from its prior underground installation and cleaned for reuse with this invention.

To prepare an uncoated or a previously used steel tank, it is desirable that the exterior surface be conventionally sandblasted and coated with a rust inhibitive paint. Then, to simplify subsequent steps, it is preferred but not required that a spindle be attached, such as by welding, to the center of each tank head or end portion, collinear with the axis of the tank. As shown in FIG. 1, these spindles 4 and thus the inner tank 2, may then be supported off the ground on conventional uprights 6, shown in FIG. 1. This provides for rotation of the tank about its axis for purposes to be set forth below.

In the next step of the present invention, a spacing material is applied to at least a portion, preferably the lower portion, of the exterior surface of the inner tank 2 and may be applied to the entire exterior surface of the tank 2. This spacing material 8 may comprise any type of material that will provide for substantially free passage of liquids along at least a substantial portion of the internal tank 2 exterior surface. In the preferred embodiment illustrated in FIG. 1, the spacing material may suitably comprise a perforate material such as an open wire mesh. This may suitably be the type of mesh conventionally used in reinforcing concrete structures, although other types of spacing material that have solid portions separated by and defining voids may also be used. Such a spacing material could also comprise a sheet or coating of porous material, so long as it provides for the necessary substantially free passage of liquids along a substantial portion of the internal tank exterior surface.

In the preferred embodiment the wire mesh 8 may be laid over the circular cylindrical walls of the inner tank 2 and welded in place at spaced intervals, with the ends of the mesh extending slightly over the ends or heads of the tank 2. It is to be understood that this spacing material 8 may be held by strapping or other convenient manner to the tank 2 simply to hold it in place temporarily while the exterior sheath, described below, is being applied.

The exterior sheath of the tank of this invention may be fabricated in a number of different ways. One advantageous method comprises the wrapping of the exterior cylindrical walls of the tank with a web of imperforate material such as a stretched film 10 of synthetic resin, such as polyethylene or the like, that is stretched over the spacing material 8 as the tank is rotated on its spindles 4. This application of stretched film 10 over the spacing material 8 prevents subsequent material used in forming the outer sheath from contacting those portions of the inner tank 2 over which the spacing material 8 is applied. Various other material could likewise be substituted in place of the stretched film to support the subsequent layers of the sheath. Additionally, with appropriate selection of materials used in fabricating the sheath, it is also possible to dispense with the use of this stretched film 10.

In this preferred embodiment the rigid outer sheath 12 preferably, and particularly the cylindrical sidewall portions 14 thereof, are formed by bonding resin impregnated glass fiber mats to the film 10 in a conventional manner. It has been found convenient to lay sections of such glass fiber matting over the film-wrapped inner tank and then apply suitable and well known resins to that matting, although matting that is preimpregnated with resin could be used with equal facility. While the thickness of the outer sheath 12 may vary according to the severity of conditions anticipated, it should be of sufficient thickness to provide a substantially rigid sheath. It has been found that one-quarter inch thickness of the cured, resin impregnated glass fiber matting generally provides sufficient strength and rigidity for the sheath.

To form the end portions 16 of the sheath 12, the resin impregnated glass fiber mat may be simply laid and wrapped around the tank end portions, forming a continuous structure with the cylindrical sidewalls. If this technique is used, the spacing material 8 may either be continued over those end portions or may be omitted from the end portions. If it is omitted, it is preferable to coat the end portions of the tank with a release agent to prevent the fiberglass resin from bonding to the end portions of the tank 2. This continuous application of the glass fiber material may be effected with the tank still supported by the spindles 4 or with those spindles cut off. If the spindles are retained, they may be cut off at a later time and a patch placed over the hole left by the spindle. This continuous layup method of forming the end portions 16 of the sheath 12 is illustrated in the partial sectional view of FIG. 3.

Alternatively and preferably the end portions 16 of the sheath 12 may be fabricated separately from the cylindrical side wall portion 14. Such a technique, illustrated in the fragmentary sectional view of FIG. 4, provides substantially the same end result as the continuous layer process shown in FIG. 3. However, this method of forming the end portions 16 separately may simplify the manufacture by permitting the formation of those end caps over a male mold plug, thus permitting the glass fiber material to be laid substantially horizontally instead of vertically, as is required in the continuous lay-up approach of FIG. 3.

As shown in FIG. 4, a tube 18 may be bonded into one or both of the end portions 16, extending from a point adjacent the lowermost portion of the interior of outer sheath 12 through an aperture formed in the upper portions of outer sheath 12. In this embodiment the tube 18 extends between the inner surface of the end portion 16 of the outer sheath 12 and the exterior surface of the end wall of inner tank 2. The tube 18 could, alternatively, be located away from the end portions and extend between the respective cylindrical side wall portions of the tank 2 and outer sheath 12. This tube 18 may conveniently be bonded into the sheath end portions 16 either during the lay-up of that end portion or subsequent thereto, and preferably prior to the assembly of the end portion 16 onto the cylindrical portions 14 of the sheath 12.

The remaining steps involved in the manufacture of the double wall tank of this invention may depend upon the nature of the inner tank 2 used in manufacturing the product. If the tank 2 is a previously used unit, or one that already incorporates a manhole or other aperture for access to the interior, such as element 20 shown in FIGS. 2 and 6, and may also include other plumbing connectons, the application of the exterior sheath 12 is preferably done in a manner that bonds around those fittings and apertures, while providing for access to them. With this situation litle additional work may be necessary to complete the manufacture of the product of this invention.

Figure 5:
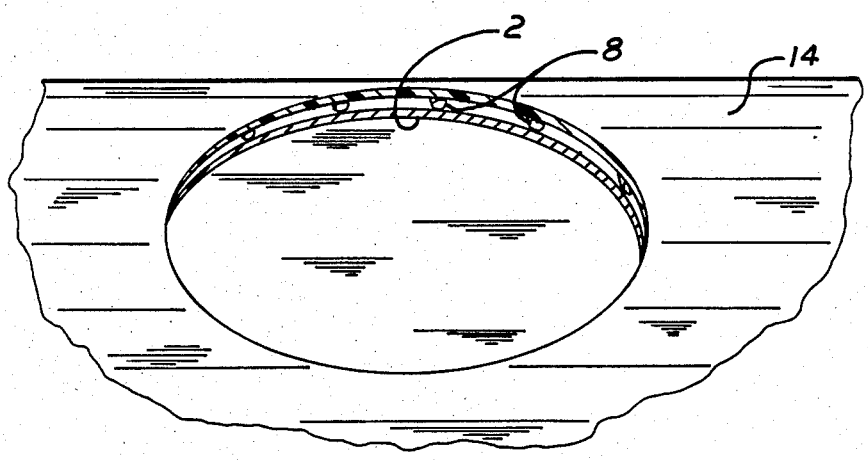
FIG. 5 is a fragmentary upper perspective view of the tank of FIG. 1 illustrating the cutting of an aperture through the tank wall and outer sheath.

If the inner tank 2 from which this article is manufactured is a new tank, or a remanufactured one in which there exists no apertures or fittings, it is easiest to apply the sheath 12 around these cylindrical sidewalls in a continuous manner. Then to form the necessary opening into the interior of the tank, appropriate holes may then be cut by any suitable means, such as a hole saw or the like. In most tanks it is desirable to provide access to the interior that is large enough for entry of a person into the tank. This may be done by forming an aperture, as by cutting, through the outer sheath 12, the spacing material 8 and a portion of the cylindrical sidewall of the inner tank 2, as shown in FIG. 5. Then, preferably from inside the tank, a hollow cylindrical member 20, preferably having a shape and size corresponding generally to the shape and size of the aperture cut, is sealingly joined to the cylindrical side wall of the tank 2, suitably by welding the joint adjacent the periphery of the aperture to the inner tank 2. This then provides the necessary manhole. Additional holes may be cut through the sheath 12 and inner tank 2 for insertion and attachment, suitably by welding, of additional fittings such as for introduction and withdrawal of liquid from the tank. When all of these fittings have been affixed to the tank, the portions of the sheath 12 adjacent those various fittings may then be bonded thereto with appropriate resin, to yield a finished structure as shown in the fragmentary perspective view of FIG. 6.

Figure 3:
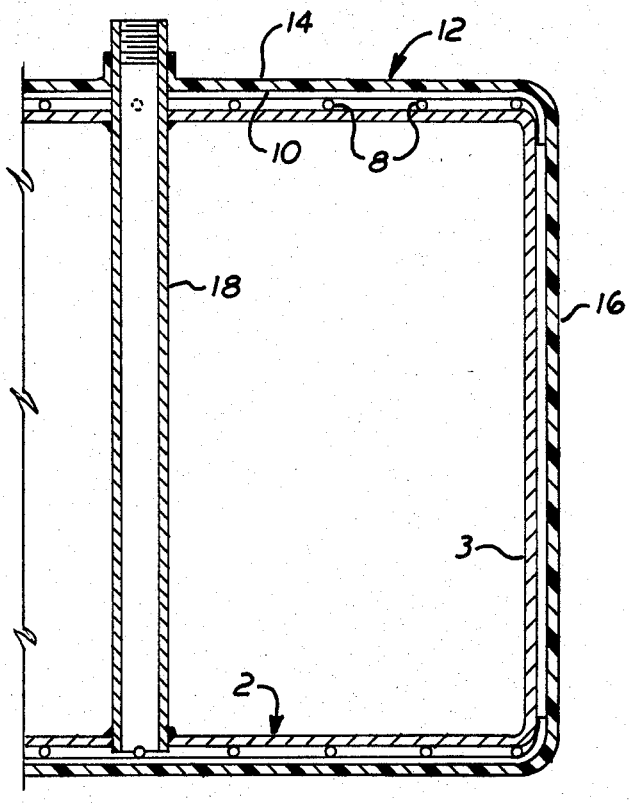
FIG. 3 is a partial side sectional view taken along line 3—3 of FIG. 2.
Figure 4:
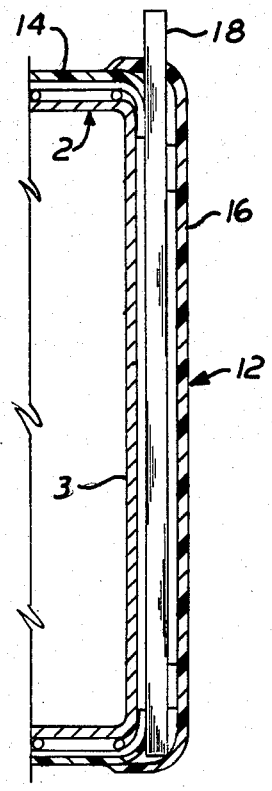
FIG. 4 is a side sectional view, similar to FIG. 3 but of a different embodiment of the end structure of the tank.

A suitable coverplate 22 may be provided for the cylindrical member 20 as shown in FIG. 3. This coverplate may conventionally be secured to the upper flange 24 of that cylindrical member 20 by conventional means, such as a plurality of bolts 26 extending through the coverplate 22 and the flange 24. In this coverplate may be provided such items as a lifting ring 28 and conventional fittings 30 and 32 to provide for insertion of appropriate plumbing to facilitate introduction and withdrawal of liquids to be stored within the completed tank.

Figure 2:
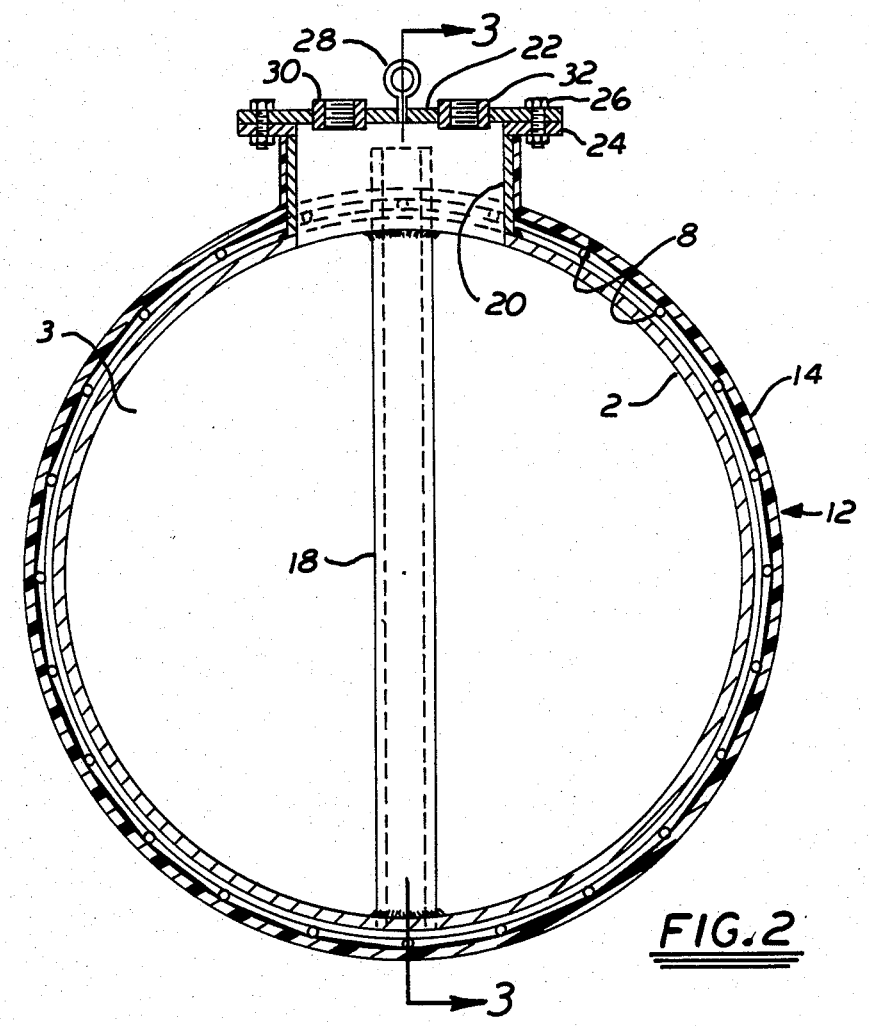
FIG. 2 is an end sectional view of a completed tank according to FIG. 1.

An alternative positioning for the tube for use in detecting the presence of liquid in the space between the inner tank 2 and sheath 12 is illustrated in FIGS. 2 and 3. In this embodiment, the tube, instead of extending within the space between the exterior of tank 2 and the inner surface of the outer sheath 12, as in FIG. 4, extends through the tank itself. This tube 18 may be installed by providing an aperture through the cylindrical sidewall of the outer sheath 12, through the adjacent upper portion of the inner tank 2 and then through the diametrically opposed lowermost portion of the inner tank 2. Thus, the tube may be inserted through the outer sheath aperture and extend through the tank and through the aperture in the lowermost portion thereof, so that the lower portion of tube 18 is adjacent the lower portion of the space between the inner tank 2 and sheath 12. The joints between the tube 18 and the outer sheath 12 of the inner tank 2 are sealed liquid-tight in conventional manners. This structure shown in FIG. 3 provides substantially the same function for detecting the presence of liquid between the inner tank and sheath as does the structure of FIG. 4 and exchanges the somewhat more complicated installation for the benefit of additional rigidity in being attached, as by welding, to the inner tank 2 itself. In the structures of both FIG. 3 and FIG. 4 the tube 18 provides the means within the space between the inner tank exterior surface and the outer sheath inner surface for detecting the presence of liquids within that space and for withdrawing such liquid, if desired.

On completion of the manufacturing steps set forth above both the inner tank 2 and its sheath 12 may have pressure applied to them, as by compressed air. With the apparatus illustrated in FIG. 3 the application of pressure through the tube 18 will not only permit the testing of the sheath 12 for any leakage but also will permit the testing of the tank 2 to ascertain if there is any leakage of that pressurized air from the space between the sheath 12 and the inner tank 2 into that inner tank 2. Such application of pressure will also serve to pop free any portion of the end caps 16 that may have stuck to the release agent applied to the end portions 3 of the inner tank 2, in order to permit the passage of liquids along the exterior surface of the end portions 3 of the inner tank 2.

By the foregoing construction there is thus provided a double wall tank that can be manufactured economically from a conventional steel wall tank, and even from a used tank that has previously been removed from underground storage use. This structure provides an exterior sheath, which may be formed from a material that is free of any tendency to rust or corrode, and which is spaced from the inner tank to permit the collection within that space and thus detection of any liquids leaking into that space, either from the tank or from sources exterior to the sheath. Thus may be determined the existence of any leakage of either the tank or the sheath by simply detecting the presence and nature of any liquid present in that space. By the use of a relatively thick and rigid outer sheath, the strength of that sheath is enhanced over similar structures that may use flexible outer covering. Furthermore, such a rigid external sheath permits testing of the integrity of the sheath and tank at substantial pressures, which could not be done with a flexible covering without danger of rupture.

While the foregoing describes in detail several preferred embodiments of the tank of this invention, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited solely by the claims appended hereto.

What is claimed is:

1. A method of manufacturing from a rigid, single wall inner tank for storage of liquids comprising the steps of applying to at least a portion of the exterior surface of said rigid inner tank a spacing material providing for substantially free passage of liquids along a substantial portion of said inner tank exterior surface;

stretching over said inner tank exterior surface and said spacing material a film of imperforate material to separate said inner tank and said spacing material from subsequently applied sheathing material; and applying over said inner tank exterior and said spacing material and said film overlying said spacing material a substantially rigid outer sheath of a material that is substantially liquid-tight, said sheath being spaced from at least a portion of said inner tank exterior surface by said film and said spacing material, whereby is provided a rigid double wall tank.

2. The method of claim 1 wherein said spacing material includes solid portions separated by and defining voids.

3. The method of claim 1 wherein said spacing material comprises a perforate material.

4. The method of claim 3 wherein said perforate material comprises a mesh material.

5. The method of claim 1 wherein said sheath comprises at least one layer of fibrous material coated with a curable resin which, upon curing, provides a coating that is resistant to passage of water or hydrocarbon liquids.

6. The method of claim 5 wherein said fibrous material comprises a mat of glass fibers.

7. The method of claim 1 wherein said inner tank has the configuration generally of a cylinder with closed ends and wherein said spacing material is applied to the cylindrical wall portions thereof, whereby the spacing material will serve to space the outer sheath radially from the outer surface of the cylindrical wall of the inner tank, with the sheath being of a generally cylindrical form with cylindrical wall portions and closed end portions.

8. The method of claim 7 wherein the cylindrical wall portions of said outer sheath overlying said inner tank cylindrical wall portions are formed separately from the end portions of said sheath overlying the closed end portions of said inner tank and wherein said sheath end portions are sealingly joined to said sheath cylindrical wall portions, whereby is formed a continuous outer sheath overlying said inner tank.

9. The method of claim 8 wherein said inner tank includes at least one aperture through a wall thereof for providing access to the interior of said inner tank and wherein said sheath is applied in such a manner that the completed tank retains access to the interior thereof through said aperture.

10. The method of claim 1 further comprising the step of forming an aperture through said sheath, said spacing material and through a portion of a wall of said inner tank, whereby is provided access to the interior of said inner tank.

11. The method of claim 10 further comprising the steps of sealingly joining to said wall of said inner tank adjacent the periphery of said aperture therethrough a hollow cylindrical member having a cylindrical shape and size corresponding generally to shape and size of said inner tank aperture and sealingly joining said outer sheath to said hollow cylindrical member.

12. The method of claim 1 further comprising the steps of forming of an aperture through said outer sheath and the insertion of tube means through said aperture and extending between the inner surface of said outer sheath and said inner tank exterior surface to a point adjacent a lower portion of said outer sheath inner surface, and the forming of a liquid-tight joint between the exterior surface of said tube member and said outer sheath, whereby any liquid within the space between the inner tank and the outer sheath may be contacted by and withdrawn through the tube means.

13. The method claim 1 further comprising the steps of providing apertures through the upper portions of said outer sheath and said inner tank and through a lower portion of said inner tank, the insertion of tube means through said apertures and extending between a point exterior to said outer sheath and said inner tank and a point adjacent a lower portion of the inner surface of said outer sheath, and the forming of liquid-tight joints between said tube means and the peripheries of said apertures, whereby any liquid within the space between the inner tank and the outer sheath may be contacted by and withdrawn through the tube means.

14. A tank for storage of liquids comprising a substantially rigid inner tank having means for introducing thereinto and withdrawing therefrom liquids to be stored;

a spacing material overlying a substantial portion of the exterior surface of said inner tank, said spacing material providing for passage of liquids along the portions of the exterior surface of said inner tank underlying said spacing material; and a substantially rigid outer sheath formed of a resin impregnated fibrous material that is substantially liquid tight, said outer sheath enclosing said inner tank and said spacing material and having at least a portion thereof spaced from said inner tank by said spacing material;

a film of imperforate material interposed between said resin impregnated fibrous mateial and said spacing material, whereby is formed a double wall tank having at least a portion of the outer sheath thereof spaced from the inner tank.

15. A tank according to claim 14 wherein said spacing material overlies at least the lower portions of said inner tank when said tank is in its normal orientation, whereby any liquid introduced between the inner tank exterior surface and the outer sheath inner surface will collect in the lower portions of the outer sheath inner surface.

16. A tank according to claim 15 further comprising means located within the space between said inner tank exterior surface and said outer sheath inner surface for detecting the presence of liquids within that space.

17. A tank according to claim 16 wherein said liquid detecting means comprises tube means extending from outside said tank to a point adjacent said lower portions of said outer sheath inner surface, whereby any liquid introduced between the inner tank exterior surface and the outer sheath inner surface may be drawn into that tube.

18. A tank according to claim 17 wherein said inner tank and said outer sheath are both configured generally as right circular cylinders with closed ends and wherein at least one end portion of said outer sheath is spaced from the corresponding end portion of said inner tank and wherein said tube means extends through an upper portion of said outer sheath and between said outer sheath and said inner tank to said point adjacent said outer sheath inner surface lower portion.

19. A tank according to claim 13 wherein said tube means extends through upper portions of said sheath and the sidewall of said inner tank, through the interior of said tank and through a lower portion of said inner tank sidewall, whereby a sensing device may be inserted through the tube means to sense the presence of liquid between the lower portion of the inner tank and the outer sheath.

* * * * *